US008403000B2

(12) United States Patent
Adkins et al.

(10) Patent No.: US 8,403,000 B2
(45) Date of Patent: Mar. 26, 2013

(54) ASSEMBLY AND SYSTEM FOR TANK FILLING, WITHDRAWAL AND PRESSURE MANAGEMENT OF A CRYOGENIC LIQUID

(75) Inventors: Roy E Adkins, Catlett, VA (US); Harold E Sutton, Fort Collins, CO (US)

(73) Assignee: Cryogenic Fuels, Inc., Fairfax, VA (US)

( * ) Notice: Subject to any disclaimer, the term of this patent is extended or adjusted under 35 U.S.C. 154(b) by 0 days.

(21) Appl. No.: 13/167,109

(22) Filed: Jun. 23, 2011

(65) Prior Publication Data

US 2012/0000209 A1 Jan. 5, 2012

Related U.S. Application Data

(62) Division of application No. 12/264,898, filed on Nov. 4, 2008, now abandoned.

(51) Int. Cl.

| | |
|---|---|
| ***F17D 1/12*** | (2006.01) |
| ***F17D 1/18*** | (2006.01) |
| ***F17C 9/02*** | (2006.01) |

(52) U.S. Cl. ... 137/588; 137/592; 137/210; 137/115.13; 62/50.1

(58) Field of Classification Search ..... 137/588, 137/590, 591, 592, 209, 210, 599.09, 599.11, 137/115.13; 62/45.1, 48.1, 50.1, 50.2, 50.7
See application file for complete search history.

(56) References Cited

U.S. PATENT DOCUMENTS

| | | | | |
|---|---|---|---|---|
| 2,576,985 | A * | 12/1951 | Wildhack | 62/50.2 |
| 3,103,791 | A | 9/1963 | Robb | |
| 3,364,688 | A | 1/1968 | Matlow et al. | |
| 4,625,777 | A | 12/1986 | Schmidt | |
| 5,329,777 | A * | 7/1994 | Weltmer, Jr. | 62/49.2 |
| 5,651,473 | A | 7/1997 | Preston et al. | |
| 6,634,519 | B2 | 10/2003 | Pelloux-Gervais et al. | |
| 6,799,429 | B2 * | 10/2004 | Drube et al. | 62/50.2 |
| 7,168,466 | B2 | 1/2007 | Ganachaud et al. | |
| 2007/0068954 | A1 | 3/2007 | Immel et al. | |

FOREIGN PATENT DOCUMENTS

| | | |
|---|---|---|
| KR | 100844223 | 7/2008 |
| WO | 2008/085005 | 7/2008 |
| WO | WO 2008085005 A1 * | 7/2008 |

* cited by examiner

*Primary Examiner* — John K Fristoe, Jr.
*Assistant Examiner* — Atif Chaudry
(74) *Attorney, Agent, or Firm* — O'Brien Jones PLLC

(57) ABSTRACT

A tank for a cryogenic liquid is fitted with a conduit assembly that provides for flow of the cryogenic liquid into and out of the tank, venting of the tank and control of the fill level in the tank. The conduit assembly includes serpentine tubes that extend into an upper region within the inner shell. Within the inner shell, one of the tubes extends downwardly to a lower opening and provides for liquid flow into and out the tank; the other tube has an end with a downwardly facing opening in the upper region whereby vapor can be conducted out of the tank and the fill level is established. A system for effecting pressure management of the cryogenic liquid in the tank includes a conduit network that provides for pressure build as pressure in the conduit network drops and provides for delivery of liquid only to, e.g., a vehicle engine.

14 Claims, 4 Drawing Sheets

ASSEMBLY AND SYSTEM FOR TANK FILLING, WITHDRAWAL AND PRESSURE MANAGEMENT OF A CRYOGENIC LIQUID

RELATED APPLICATION

This is a division of application Ser. No. 12/264,898, filed Nov. 4, 2008 now abandoned, the entire content of which is incorporated herein by reference.

BACKGROUND OF THE INVENTION

1. Field of the Invention

The present invention is directed to an assembly for effecting filling, withdrawal and fill level control of a cryogenic liquid held in a tank and to a flow control and pressure management system for a cryogenic liquid. More particularly, the present invention is directed to such an assembly and system applied to a vehicle-mounted tank for receiving and holding a cryogenic liquid fuel and for delivering the liquid fuel to the vehicle engine. The liquids intended for transfer by the apparatus and method of this invention exist in a cryogenic state. The present invention is particularly adapted for, but not limited to, a vehicle-mounted tank for efficiently holding liquefied natural gas (LNG), or methane, and a control assembly for efficiently introducing the LNG into the tank and transferring the LNG to the vehicle engine.

2. Description of Related Art

Cryogenic containers that are designed and manufactured for end-use as vehicular fuel tanks used to store extremely cold liquids require a means to fill the container and deliver product from the container. Typically, LNG vehicle fuel tanks are of double wall construction. The inner shell, a pressure vessel containing LNG fuel, is supported within the outer shell. Radiation shielding, such as wraps of polyester sheet aluminized on both sides, is placed in the space between the inner and outer shells, and the space is placed under a high vacuum to provide particularly effective insulation between the inner shell and the ambient. Since LNG is a cryogenic fuel that boils at −258° F. (at normal atmospheric pressure), the pressure vessel support structure must exhibit a very low conductive heat leak. Tank "heat leak" has a dramatic effect on the pressure temperature and density relationships of the LNG thus making it very difficult to control the fuel tank pressure and maintain consistent fuel quality for delivery to the engine. Low heat leak minimizes tank pressure build-up during vehicle non-operational time periods and prevents venting of fuel during a designed "no vent" standby time.

OBJECTS AND SUMMARY OF THE INVENTION

LNG is a dynamic fuel exhibiting fluid characteristics that vary with pressure and corresponding amount of internal energy. These variable fluid characteristics coupled with a cryogenic liquid temperature of −258° F. at normal atmospheric pressure necessitate specific equipment and a system design that will enable efficient introduction of LNG into the tank(s) with an effective control of fill level in the tank. Also, the system controls must maintain a specified fuel supply flow rate to a vehicle engine within a specified pressure range during all modes of vehicle operation.

An object of the invention is to effect the fill of the tank, the delivery of liquid from the tank and achieve pressure management of the tank with a single line thus providing a multi-function capability and reducing the number of tank penetrations and therefore a significant reduction in heat transfer.

Another object of the present invention is to provide a reliable means of controlling the ullage space within the tank in order to comply with applicable Federal and State codes in the United States. The vent return line, as employed in the invention, serves as a device that provides an indication of when the tank is filled to the maximum allowable liquid level and will allow for the expansion of the LNG after the fill of the tank. This is accomplished by means of a tubular elbow welded to the end of the vent line serpentine tube in the interior of the tank, in a position perpendicular to the liquid surface of the LNG. With the entrant tube housing assembly installed in the upper part of the tank head it is possible to establish the exact elevation of this elbow above the liquid level and thereby provide a flow path for the liquid out of the tank while at the same time establishing a pressure pad at the top of the tank that prevents the tank from being overfilled.

An object fulfilled by the invention is that, due to improved thermal protection design, "liquid only" can be delivered from the tank, thus assuring consistent fuel quality and pressure from the tank to an external heat exchanger for vaporization and delivery to an engine.

Another object of the present invention is to provide for the reliable installation of a capacitance gauge probe in combination with the liquid fill/withdrawal tube. The capacitance probe is attached to the entrant tube unit by fittings welded to the vertical portion of the fill/withdrawal tubing.

The filling, venting, pressure management and flow control assembly and system provided by this invention will satisfy applicable codes for maximum allowable tank fill level as well as the fuel pressure and flow rate requirements of any vehicle engine.

DETAILED DESCRIPTION OF PREFERRED EMBODIMENTS

Figures 1A, 1B:
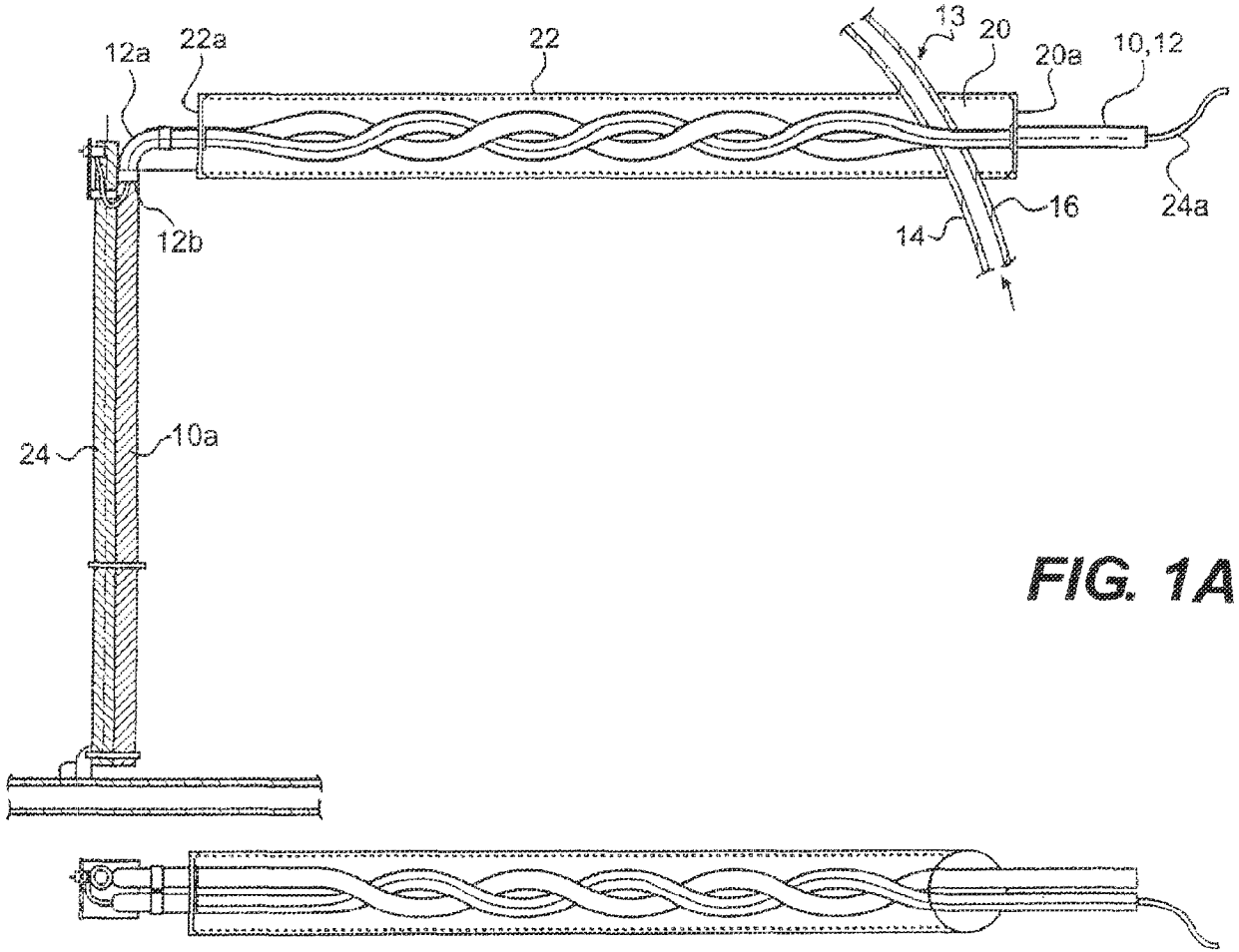
FIG. 1A is an illustration of an assembly for filling, venting and fill level control of a cryogenic liquid.
FIG. 1B is a top view of the assembly, constructed according to the present invention.
Figure 2:
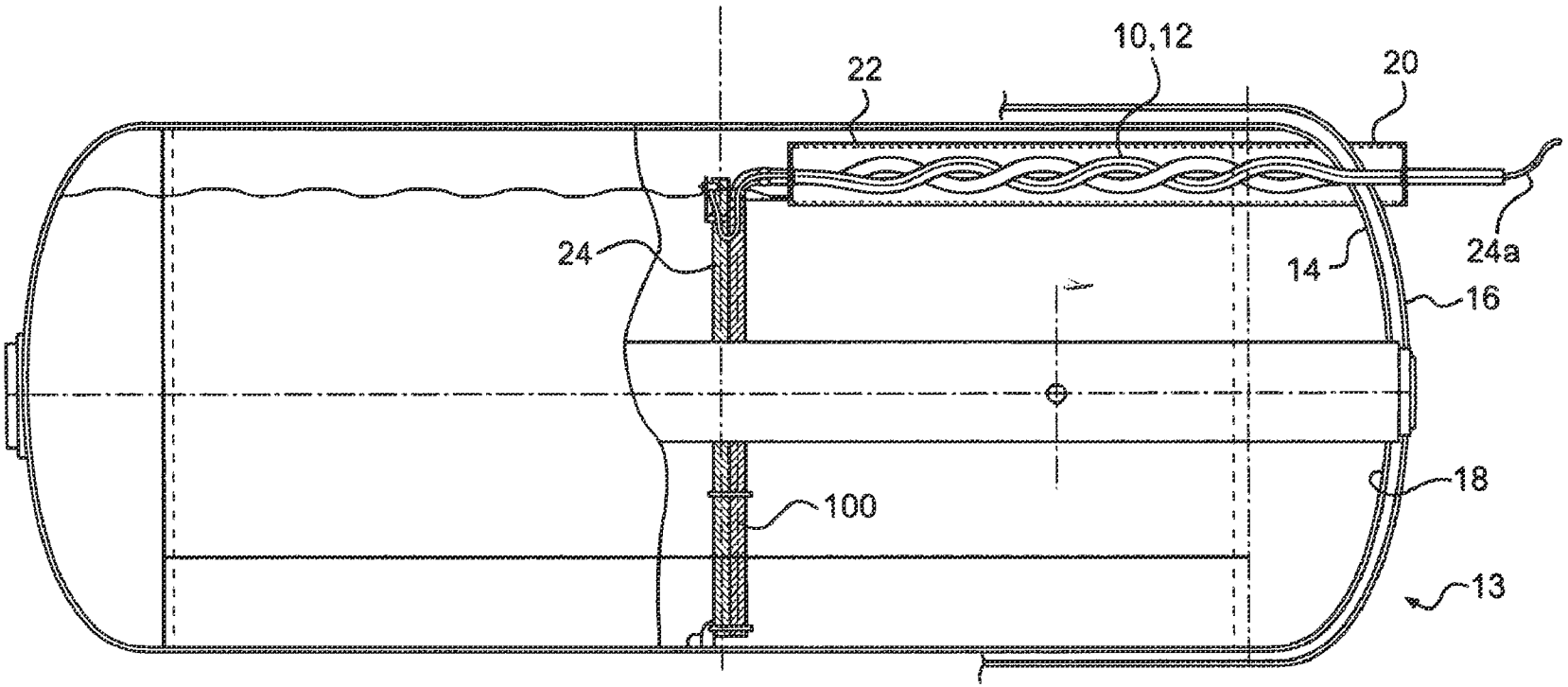
FIG. 2 is a cross-sectional illustration showing the assembly of FIG. 1 installed in a double-wall tank.

As shown in FIGS. 1 and 2, a conduit assembly includes a pair of tubes 10, 12 that extend through an end wall of a tank 13 for a cryogenic liquid. A tank to which the conduit assembly is applicable is disclosed in U.S. Pat. No. 6,880,719 B1. The tank makes use of a double wall construction having an inner shell 14 that holds the liquid under pressure and an outer shell 16 that surrounds the inner shell and is spaced from it. A barrier to heat transfer into the inner shell is provided by an evacuated space 18 between the inner and outer shells.

As shown, the tubes have a serpentine form and extend side-by-side horizontally within an upper region of the inner shell. As best shown in FIG. 1, the tubes extend through outer and inner housings 20, 22 forming an extension of the evacuated space between the inner and outer shells. In particular, the tubes extend through a closure plate 20*a* on the outer housing, through the evacuated space between the shells, through the inner housing and closure plate 22*a* and into an upper central region of the inner shell.

One of the tubes 10, used for filling and withdrawal of liquid, includes a vertical section 10*a* that extends toward the bottom of the inner shell and has an opening at its lower end. Located adjacent to the vertical section 10*a* of tube 10 is a liquid level capacitance gauge 24.

The other tube 12, used for venting and fill level control, terminates in the upper central region of the inner shell at an elbow with a downwardly facing opening 12*b*. An electrical lead 24*a* from the capacitance gauge 24 is shown extending through the vent tube.

A cryogenic liquid from a bulk supply flowing through the fill tube enters the inner shell at the bottom. As the liquid level rises, gases above the surface of the liquid can flow from the inner shell through the vent tube 12 and back to the bulk supply. When the liquid level rises to immerse the bottom of the elbow 12*b*, liquid will flow through the vent tube back to the bulk supply. A gas pressure pad established above the surface of the liquid will prevent further rise of the liquid in the inner shell. The elbow is located so that the downwardly facing opening is generally coincident with the fill level mandated by applicable codes. The position of the elbow also establishes the proper "ullage space" (tank space not occupied by liquid) in the container, to allow for expansion of the LNG after filling.

Figure 3A:
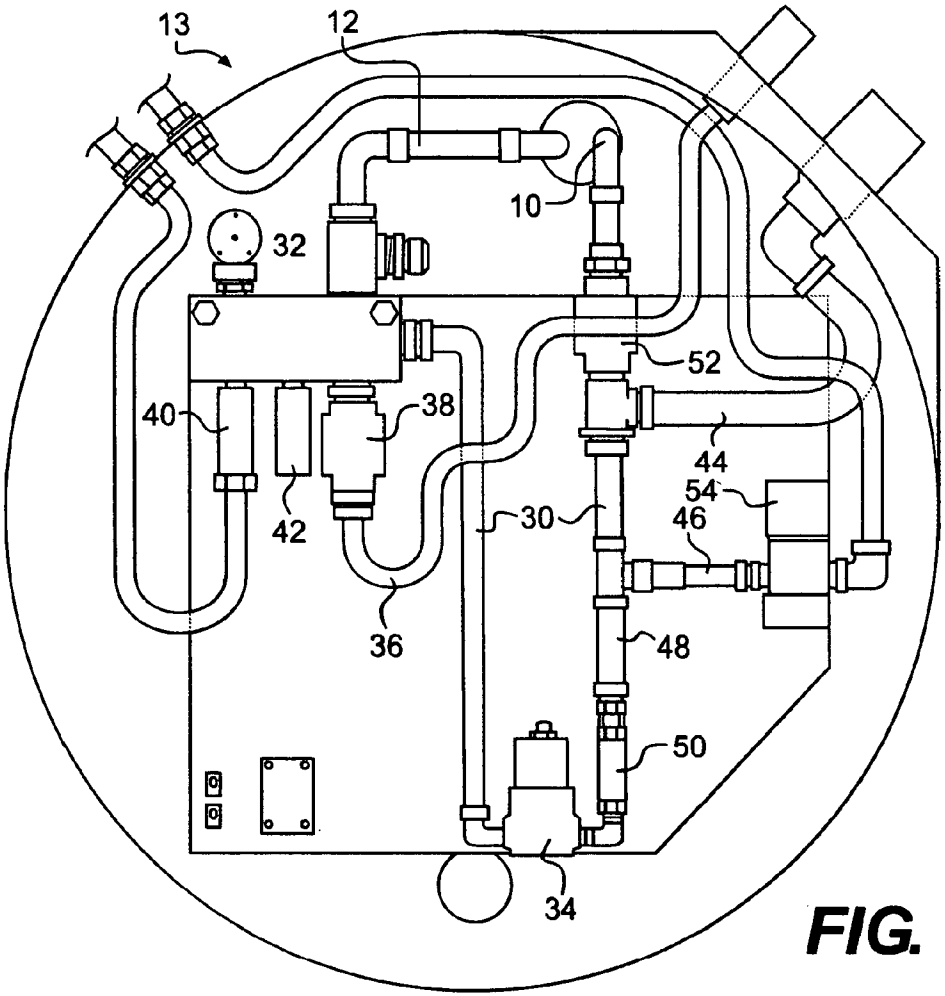
FIG. 3A is a front elevation illustration of a flow control and pressure management system of the present invention installed on an end wall of a tank.
Figure 3B:
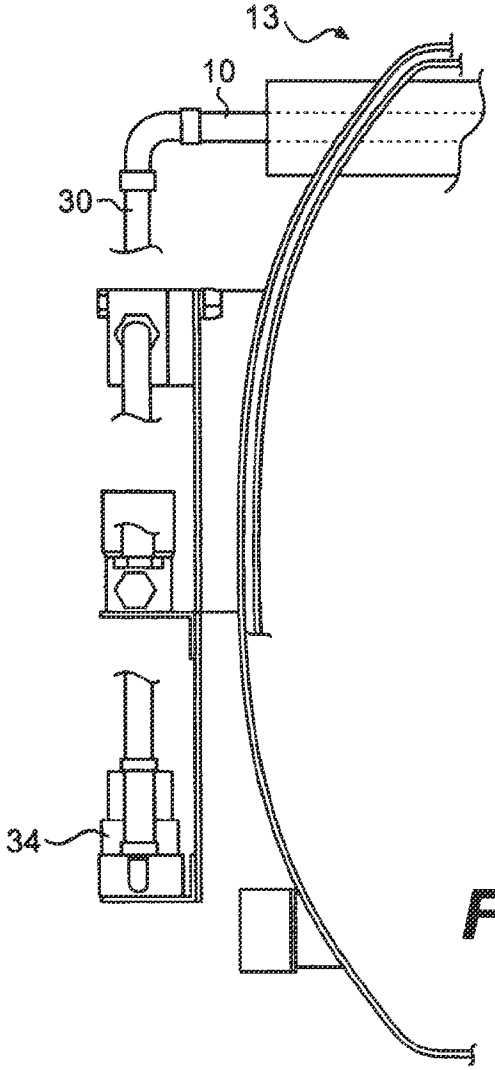
FIG. 3B is a side elevation illustration of the flow control and pressure management system shown in FIG. 3A.

FIGS. 3A and 3B show a preferred embodiment of a system for effecting flow control and pressure management of a cryogenic liquid held in a tank. An end of conduit 30 is coupled to the outer end of fill and withdrawal conduit 10 that communicates with the bottom of tank 13. The other end of conduit 30 is coupled to an outer end of tank vent conduit 12 via a passage in manifold 32 A pressure regulator 34 is disposed in conduit 30 between its couplings with conduits 10 and 12. Thus, conduit 30 forms a loop between fill and withdrawal conduit 10 and vent conduit 12, and the pressure regulator 34 is interposed in the loop. The pressure regulator incorporates a normally closed valve that opens in response to a drop in pressure in conduit 30 below a predetermined level. A pressure regulator found to be suitable for this application is RegO Products Part No. RG125.

A conduit 36 for conducting vapor from the tank to a bulk supply is coupled to conduit 30 via a passage in the manifold 32 a shut off valve 38 (normally open) is disposed in conduit 36. Also coupled to the manifold are primary and secondary relief valves 40 and 42. Teed into conduit 30 between the coupling with conduit 10 and the pressure regulator are conduit 44 which receives cryogenic liquid from a bulk supply (not shown), and conduit 46 which conducts cryogenic liquid to a point of use, such as a vehicle engine (not shown). As shown, an accumulator 48 and a check valve 50 are also disposed in conduit 30 between the regulator and the coupling with conduit 46. A shut-off valve 52 (normally open) is disposed in conduit 30 between the couplings with conduits 10 and 44. A solenoid valve 54 is disposed in conduit 46 to allow or block flow of liquid to a point of use.

The regulator 34 will maintain a constant delivery pressure to an engine. When liquid is being provided to an engine, the liquid level in the tank will fall and the pressure in conduit 30 may also fall. When the pressure in the conduit 30 falls below a predetermined level, the valve in the regulator 34 will open, liquid in the accumulator 48 will pass through check valve 50 and regulator 34 and into the conduit 30 on the other side of the regulator. This section of conduit 30 acts as a heat exchanger in which liquid in the conduit will be vaporized by heat from ambient, causing expansion of the fluid in the conduit which causes a pressure build. In practice, very small amounts of liquid passing through the check valve 50 and the regulator 34 effect a pressure build that returns the pressure in conduit to a required level. When the pressure reaches the predetermined level, the regulator shuts off, stopping vaporization and pressure build-up. As liquid is forced from the tank, pressure in the tank begins to drop and the pressure build regulator again begins operating.

In some cases, where the LNG saturation pressure is above the minimum tank operating pressure, the pressure build system, just described, will never be activated at any flow rate of fuel from the tank. Minimum pressure is controlled by the liquid saturation pressure. However, when liquid saturation pressure is below the specified minimum tank operating pressure, or in any case where pressure has decayed at low tank quantity with high flow rates, the pressure build system will maintain pressure within the required operating range.

Excessive pressures in conduit 30 are relieved by the opening of primary and/or secondary relief valves 40, 42.

The invention claimed is:

1. A system for effecting flow control and pressure management of a cryogenic liquid held in a tank, the system comprising:

a first conduit communicating with the interior of the tank near the bottom of the tank;

a second conduit communicating with the interior of the tank at an upper region of the tank;

a third conduit communicating with the first and second conduits and extending between the first and second conduits outside of the tank;

a pressure regulator disposed in the third conduit, the pressure regulator comprising a normally closed valve that opens in response to a pressure drop in the third conduit below a predetermined level;

a one-way valve and an associated accumulator disposed in the third conduit between the first conduit and the pressure regulator;

a fourth conduit for conducting vapor from the tank to a bulk supply, the fourth conduit being joined to the third conduit between the second conduit and the pressure regulator;

a fifth conduit for introducing cryogenic liquid from a bulk supply to the tank, the fifth conduit communicating with the third conduit between the first conduit and the one-way valve; and a sixth conduit for conducting cryogenic liquid to a point of use, the sixth conduit being joined to the third conduit between the first conduit and the one-way valve, wherein the pressure regulator is configured to maintain a constant delivery pressure to the point of use as a level of cryogenic liquid in the tank falls and the pressure in the third conduit falls below a predetermined level, a valve in the pressure regulator opens, allowing cryogenic liquid in the accumulator to pass through the on-way valve and the pressure regulator and into the third conduit on the other side of the pressure regulator, where the third conduit acts as a heat exchanger in which cryogenic liquid is vaporized, causing expansion of the fluid in the third conduit which causes a pressure increase in the third conduit and in the tank.

2. The system as recited in claim 1, and further comprising a reservoir for holding cryogenic liquid in the third conduit, the reservoir being located in the third conduit adjacent to the one-way valve and between (1) the fifth and sixth conduits and (2) the one-way valve.

3. The system as recited in claim 2 further comprising: a valve in the fourth conduit for allowing or blocking flow of vapor through the fourth conduit between the tank and a bulk supply; and a valve for allowing or blocking flow of cryogenic liquid through the third and fifth conduits between a bulk supply and the first conduit.

4. The system as recited in claim 2 further comprising a valve in the sixth conduit for allowing or blocking flow of cryogenic liquid through the sixth conduit between the third conduit and a point of use.

5. The system as recited in claim 1 further comprising: a valve in the fourth conduit for allowing or blocking flow of vapor through the fourth conduit between the tank and a hulk supply; and a valve for allowing or blocking flow of cryogenic liquid through the third and fifth conduits between a bulk supply and the first conduit.

6. The system as recited in claim 5, and further comprising a valve in the sixth conduit for allowing or blocking flow of cryogenic liquid through the sixth conduit between the third conduit and a point of use.

7. The system as recited in claim 1 further comprising a valve in the sixth conduit for allowing or blocking flow of cryogenic liquid through the sixth conduit between the third conduit and a point of use.

8. A system for effecting flow control and pressure management of a cryogenic liquid held in a tank, the system comprising:

a tank configured to hold a cryogenic liquid and deliver the cryogenic liquid to a vehicle engine, the tank having an outer shell and an inner shell with an evacuated space therebetween;

a passageway formed between the outer shell and the inner shell of the tank in an upper region of the tank;

a first conduit extending through the passageway and communicating with the interior of the tank near the bottom of the tank;

a second conduit extending through the passageway and communicating with the interior of the tank at an upper region of the tank;

a third conduit communicating with the first and second conduits and extending between the first and second conduits outside of the tank;

a pressure regulator disposed in the third conduit, the pressure regulator comprising a normally closed valve that opens in response to a pressure drop in the third conduit below a predetermined level;

a one-way valve and an associated accumulator disposed in the third conduit between the first conduit and the pressure regulator, the one-way valve being positioned directly and vertically below the accumulator;

a fourth conduit for conducting cryogenic liquid to a point of use, the fourth conduit being joined to the third conduit, wherein the pressure regulator is configured to maintain a constant delivery pressure to the point of use as a level of cryogenic liquid in the tank falls and the pressure in the third conduit falls below a predetermined level, a valve in the pressure regulator opens allowing cryogenic liquid in the accumulator to pass through the one-way valve and the pressure regulator and into the third conduit on the other side of the pressure regulator, where the third conduit acts as a heat exchanger in which cryogenic liquid is vaporized, causing expansion of the fluid in the third conduit which causes a pressure increase in the third conduit and in the tank.

9. The system of claim 8, wherein the tank is a vehicle-mounted tank.

10. The system of claim 8, wherein the cryogenic liquid is a cryogenic fuel.

11. The system of claim 10, wherein the cryogenic fuel is liquefied natural gas.

12. The system of claim 8, the first and second conduits extend side-by-side within the passageway.

13. The system of claim 12, wherein the first and second conduits are intertwined within the passageway.

14. The system of claim 8, wherein the passageway is a sealed, evacuated passageway.

* * * * *